US010131169B2

(12) United States Patent
Becerra Siabato et al.

(10) Patent No.: US 10,131,169 B2
(45) Date of Patent: Nov. 20, 2018

(54) HEAT-SENSITIVE RECORDING MATERIAL WITH SALICYLIC ACID DERIVATIVE AS (COLOR) DEVELOPER REACTIVE WITH A DYE PRECURSOR

(71) Applicant: MITSUBISHI HITEC PAPAR EUROPE GMBH, Bielefeld (DE)

(72) Inventors: Diana Valentina Becerra Siabato, Bielefeld (DE); Nora Wilke, Flensburg (DE)

(73) Assignee: Mitsubish HiTec Paper Europe GmbH, Bielefeld (DE)

( * ) Notice: Subject to any disclaimer, the term of this patent is extended or adjusted under 35 U.S.C. 154(b) by 0 days.

(21) Appl. No.: 15/329,903

(22) PCT Filed: Jul. 23, 2015

(86) PCT No.: PCT/EP2015/066874

§ 371 (c)(1),
(2) Date: Jan. 27, 2017

(87) PCT Pub. No.: WO2016/016084

PCT Pub. Date: Feb. 4, 2016

(65) Prior Publication Data

US 2017/0267007 A1 Sep. 21, 2017

(30) Foreign Application Priority Data

Jul. 29, 2014 (EP) ..... 14178948

(51) Int. Cl.
*B41M 5/333* (2006.01)
*B41M 5/327* (2006.01)
*B41M 5/337* (2006.01)

(52) U.S. Cl.
CPC ..... *B41M 5/3335* (2013.01); *B41M 5/3275* (2013.01); *B41M 5/3372* (2013.01); *B41M 5/3377* (2013.01)

(58) Field of Classification Search
CPC .... B41M 5/333; B41M 5/3335; B41M 5/337; B41M 5/3375
USPC ..... 503/216
See application file for complete search history.

(56) References Cited

U.S. PATENT DOCUMENTS

| | | | |
|---|---|---|---|
| 5,326,739 | A | 7/1994 | Tanabe et al. |
| 5,382,560 | A | 1/1995 | Hisada et al. |
| 2004/0258857 | A1 | 12/2004 | Dagan et al. |
| 2010/0048395 | A1 | 2/2010 | Ohga |

FOREIGN PATENT DOCUMENTS

| | | |
|---|---|---|
| CN | 1471476 | 1/2004 |
| CN | 1517233 | 8/2004 |
| CN | 1795108 | 6/2006 |
| CN | 101143531 | 3/2008 |
| CN | 101676119 | 3/2010 |
| EP | 2 546 066 | 1/2013 |
| EP | 2574645 | 4/2013 |
| JP | S62 259887 | 11/1987 |
| JP | 2006-103312 | 4/2006 |

OTHER PUBLICATIONS

Office Action dated May 4, 2018 which issued in the corresponding Chinese Patent Application No. 201580041620.2.

*Primary Examiner* — Bruce H Hess
(74) *Attorney, Agent, or Firm* — Cozen O'Connor

(57) ABSTRACT

A heat-sensitive recording material including a web-shaped substrate having a front side and an opposite reverse side, and at least one heat-sensitive recording layer on either or both of the sides of the web-shaped substrate. The heat-sensitive recording layer contains at least one dye precursor at least one salicylic acid derivative as a (color) developer reactive with this at least one dye precursor, and polyvinylpyrrolidone as auxiliary component augmenting the (color) developer the at least one salicylic acid derivative is 3,5-di(α-methylbenzyl)salicylic acid.

11 Claims, No Drawings

HEAT-SENSITIVE RECORDING MATERIAL WITH SALICYLIC ACID DERIVATIVE AS (COLOR) DEVELOPER REACTIVE WITH A DYE PRECURSOR

CROSS REFERENCE TO RELATED APPLICATIONS

This is a U.S. national stage of application No. PCT/EP2015/066874, filed on Jul. 23, 2015. Priority is claimed on the following application European Application No. EP14178948.7, filed Jul. 29, 2014, the content of which is incorporated here by reference.

BACKGROUND OF THE INVENTION

1. Field of the Invention

The invention relates initially to a heat-sensitive recording material comprising a web-shaped substrate and at least one heat-sensitive recording layer, formed on either or both of the sides of the web-shaped substrate. The heat-sensitive recording layer contains at least one dye precursor and at least one salicylic acid derivative as a (color) developer, color developer, or developer, reactive with this at least one dye precursor. Reactive with a dye precursor is to be understood as meaning that this at least one salicylic acid derivative responds to a sufficient supply of external heat by reacting with this at least one dye precursor to form a visually discernible printed image.

2. Description of the Prior Art

Recording materials that are heat sensitive and react color-formingly to the supply of external heat have been known for many years and enjoy a basically undiminished popularity, inter alia because their use is associated with immense advantages for businesses issuing tickets and/or sales receipts. Since the color-forming components, i.e., the dye precursors as well as the color developers that react therewith on heating—also known as (color) acceptors, acceptors, or color acceptors, reside in the recording material itself in such a heat-sensitive recording process, the thermal printers—which are consequently free from toner and ink cartridges and which do not require regular servicing—can be installed in large numbers. This innovative technology has become largely all pervasive in the retail trade and in public transport in particular.

In the recent past, however, increasing concerns have been raised about the environmental compatibility of certain color developers, and these, while not necessarily being science based, cannot simply be disregarded by the industry and particularly by commerce. Particularly heat-sensitive recording materials containing bisphenol-A, i.e., 2,2-bis(4-hydroxyphenyl)propane, and bisphenol-S, i.e., 4,4'-dihydroxydiphenyl sulphone, have thus attracted criticism, and this led primarily to an increased use of Pergafast® 201, i.e., N-(p-toluenesulphonyl)-N'-3-(p-toluenesulphonyl-oxyphenyl)urea, from BASF Corporation, and D8, i.e., 4-[(4-(1-methylethoxy)phenyl)sulphonyl]phenol.

Having regard to this complete and abrupt change in the marketplace, the inventors recognized a growing and sustained need for further heat-sensitive recording materials that are accepted by the public as unconcerning in health and environmental terms and that stand out from the mass of possible heat-sensitive recording materials by the particular virtue of utilizing as color developers such components as are completely or very largely biodegradable and as are also in addition approved by the public as at least health-neutral.

SUMMARY OF THE INVENTION

One aspect of the invention is a heat-sensitive recording material comprising a web-shaped substrate having a front side and an opposite reverse side, at least one heat-sensitive recording layer on either or both of the sides of the web-shaped substrate, wherein the heat-sensitive recording layer contains at least one dye precursor and at least one salicylic acid derivative as a color developer reactive with this at least one dye precursor, characterized in that:

the at least one salicylic acid derivative is 3,5-di(α-methylbenzyl)salicylic acid, the heat-sensitive recording layer further contains polyvinylpyrrolidone as auxiliary component augmenting the color developer, i.e. the above-introduced 3,5-di(α-methylbenzyl)salicylic acid, wherein the function of this auxiliary component augmenting the color developer is describable as a proton transfer inhibitor.

3,5-Di(α-methylbenzyl)salicylic acid, also known as 2-hydroxy-3,5-bis(1-phenylethyl)benzoic acid, can be represented as a component conforming to the following FIG. 1:

FIG. 1

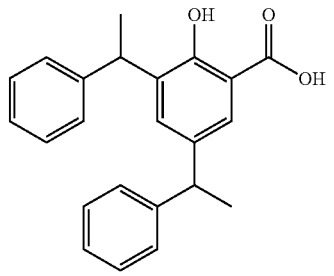

3,5-Di(α-methylbenzyl)salicylic acid is a derivative of salicylic acid. Another known salicylic acid derivative is acetylsalicylic acid, which under the trade name of Aspirin® is known as an extremely common pain reliever. Aspirin® and the 3,5-di(α-methylbenzyl)salicylic acid derivative proposed herein as a color developer for a heat-sensitive recording layer are each accordingly based on the same starting molecule. Salicylic acid as such is derivable from accessory constituents of wood by oxidative separation of the glucoside saline. Particularly high concentrations are present for example in willow bark. It need scarcely be emphasized that 3,5-di(α-methylbenzyl)salicylic acid is fully and/or very largely biodegradable.

EP 2 546 066 discloses using zinc salicylate as a (color) developer in pressure-sensitive recording materials. However, the document discloses neither any possible citation of 3,5-di(α-methylbenzyl)salicylic acid nor its combination with polyvinylpyrrolidone. Other sources do even disclose the use of salicylic acid derivatives in heat-sensitive recording layers, but only ever as an admixture to other color developers and also only ever with acceptance of known and decisive disadvantages of this component in heat-sensitive recording materials, since hitherto any percentagewise significant use of salicylic acid derivatives in heat-sensitive recording layers led in principle to an unacceptable degradation regarding the whiteness of the heat-sensitive recording layer comprising the salicylic acid derivatives. It is particularly under extreme climatic conditions such as high heat or high humidity that the use of salicylic acid derivatives and hence also the use of 3,5-di(α-methylbenzyl) salicylic acid leads to an uncontrollable degree of background greying—visible as a greyish purple tinge, this background greying being due to a continued transfer of protons from the color developer, i.e. the 3,5-di(α-methylbenzyl)salicylic acid derivative, to the dye precursor. Yet this is prevented, very surprisingly, by the combination of 3,5-di(α-methylbenzyl)salicylic acid with polyvinylpyrrolidone according to one aspect of the invention. The function of polyvinylpyrrolidone can be described as preventing or at least hindering the abovementioned proton transfer from the color developer to the dye precursor and therefore as preventing the "climate" greying, i.e. the undesirable degradation regarding the whiteness of the recording layer. Polyvinylpyrrolidone, the preferred molecular weight of which in the context of the present invention is ideally in a range extending from 9100 to 10 500 g/mol, can be represented as conforming to the following FIG. 2:

FIG. 2

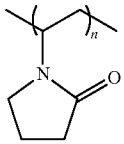

The heat-sensitive recording material proposed herein thus has a heat-sensitive recording layer which surprisingly but completely convincingly secures to the recording material a.) a high sensitivity to heat initiating a desired printed image, caused for example by the energy pulses of a thermal printhead, b.) a commercially sufficient convincing whiteness without overly disruptive background greying, and c.) economically at least still acceptable manufacturing costs, since—having regard to the last point of the above enumeration—even the best products after all have to remain affordable to the customer and/or the consumer. At the same time, the 3,5-di(α-methylbenzyl)salicylic acid derivative used as (color) developer is a very largely fully biodegradable component which, related via a conjoint starting molecule, to products used not only in human but also veterinary medical and therapeutic applications, renders obsolete any possible concerns regarding likely health hazards and biodegradability. Polyvinylpyrrolidone is well known as a component for use in the cosmetics industry, including hairsprays, and in the food industry, so this component is likewise beyond any doubt about its safeness to man and the environment.

Simply for just environmental reasons but also made technologically possible by the present invention, a special embodiment of the invention includes 3,5-di(α-methylbenzyl)salicylic acid in a range extending from 75 wt % to 100 wt %, yet more preferably in a range extending from 80 wt % to 100 wt %, all based on the total amount of color developer in the heat-sensitive recording layer, and most preferably at 100 wt % as the color developer in the at least one heat-sensitive recording layer, i.e. when in accordance with the most preferable embodiment, the heat-sensitive recording material includes exclusively 3,5-di(α-methylbenzyl)salicylic acid as color developer in the at least one heat-sensitive recording layer and most preferably in all possible heat-sensitive recording layers. Yet at the same time it must be emphasized that a combination of 3,5-di(α-methylbenzyl) salicylic acid as color developer with other color developers, especially those as explicitly recited above is not foreclosed and may possibly be sensible for stability to environmental effects especially such as humidity and/or UV irradiation, provided these other color developers are employed in a distinctly smaller amount than the 3,5-di(α-methylbenzyl) salicylic acid derivative.

In the heat-sensitive recording material proposed herein, the heat-sensitive recording layer includes a possible dye precursor comprising preferably at least one substance selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran and 3-(N-ethyl-N-tetrahydrofuryl)amino-6-methyl-7-anilinofluoran. 3-Dibutylamino-6-methyl-7-anilinofluoran—also known as ODB-2—is very particularly preferred.

To ensure a convincing dynamic printing density, the heat-sensitive recording layer preferably includes an amount of fluoran-based dye precursor, in particular of 3-dibutylamino-6-methyl-7-anilinofluoran, in a range extending ideally from 0.20 g/m$^2$ to 0.70 g/m$^2$, preferably from 0.30 g/m$^2$ to 0.50 g/m$^2$. At the same time, it is very particularly preferable when—independently thereof or, more preferably, at the same time—the wt % (bonedry) ratio of fluoran-based dye precursor to said 3,5-di(α-methylbenzyl)salicylic acid is in a range extending from 1.0:0.6 to 1.0:2.1, and more preferably in a range extending from 1.0:0.6 to 1.0:1.9.

It was further determined, in numerous investigations, that to provide a commercially persuasive heat-sensitive recording material having sufficient whiteness on the part of the heat-sensitive recording layer it is particularly preferable to ensure a wt % (bonedry) ratio of 3,5-di(α-methylbenzyl) salicylic acid to polyvinylpyrrolidone in a range extending from 1.0:0.05 to 1.0:0.3, and more preferably in a range extending from 1.0:0.1 to 1.0:0.25.

A further advantage regarding biodegradability and regarding possible concerns about harmful effects of constituents of a heat-sensitive recording material on health is also offered by one aspect of the present invention in that the heat-sensitive recording material of the present invention may completely eschew sensitizers, which is preferable for and consistent with the purposes of one aspect of the present invention. If, nonetheless, sensitizers are used, possibly for the purpose of enhancing the thermal sensitivity of response, advisable sensitizers in such a case include particularly for example: 2-(2H-benzotriazol-2-yl)-p-cresol, benzyl p-benzyloxybenzoate, methylolstearamide, stearamide, p-benzylbiphenyl, 1,2-di(phenoxy)ethane, 1,2-di(m-methylphenoxy) ethane, m-terphenyl, dibenzyl oxalate, benzyl naphthyl ether, dimethyl terephthalate and diphenyl sulphone.

Suitable binders for incorporation in the heat-sensitive recording layer include, for example, water-soluble binders such as starch, hydroxyethylcellulose, methylcellulose, carboxymethylcellulose, gelatin, casein, polyvinyl alcohols, modified polyvinyl alcohols, ethylene-vinyl alcohol copolymers, sodium polyacrylates, acrylamide-acrylate copolymers, acrylamide-acrylate-methacrylate terpolymers and also alkali metal salts of styrene-maleic anhydride copolymer or ethylene-maleic anhydride copolymer, and the binders are each usable alone or combined with each or one another; water-insoluble latex binders such as styrene-butadiene copolymers, acrylonitrile-butadiene copolymers and methyl acrylate-butadiene copolymers are also useful as binders for incorporation in the heat-sensitive recording layer. For the purposes of the present invention, polyvinyl alcohol is a particularly preferred binder which is incorporated in the heat-sensitive recording layer in a range extending from 12 to 17 wt %, based on the overall weight of the recording layer.

To improve gliding properties past a thermal head and to avoid excessive wear of the thermal head, the heat-sensitive recording layer may further comprise slip and release agents such as waxes, here in particular paraffin, oxidized paraffin, polyethylene, polyethylene oxide, stearamides and castor wax. Stearates such as, for example, zinc stearate or else calcium stearate are less suitable because their respective zinc and calcium contents destabilize the 3,5-di(α-methylbenzyl)salicylic acid derivative, causing its color-forming reaction with the dye precursors to occur within a very short time without the energy pulse of a thermal printhead.

Further constituents of the heat-sensitive recording layer in a preferred embodiment in addition to said 3,5-di(α-methylbenzyl)salicylic acid, the polyvinylpyrrolidone, a binder comprise one or more pigments, preferably inorganic pigments and most preferably one or more pigments selected from the list comprising kaolin and aluminium (hydr)oxide, of which particularly kaolin is regarded here as particularly suitable. Primarily calcium carbonate is less suitable in the context of the present invention because, owing to its pH alignment in the alkaline range, it can cause a purple-type ground coloration in the heat-sensitive recording layer. By way of dispersants for preparing a pigment dispersion to be subsequently incorporated in the heat-sensitive recording layer of one aspect of the present invention, carboxylated polyacrylates are useful for example, but the preference herein is very particularly for sulphonated polyvinyl alcohol, the combination thereof with polyvinyl alcohol as the preferred binder for incorporation in the heat-sensitive recording layer being regarded as preferable to a very particular degree.

Regarding the amount of pigment in the heat-sensitive recording layer, a particularly suitable range extends from 12 to 30 wt % (bonedry), based on the overall weight of the heat-sensitive recording layer, the lower limit being dictated by the increasing likelihood of thermal printhead deposits and the upper limit by an increasing reduction in the sensitivity to the heat from the thermal printheads which causes the printed image.

The coating apparatus to apply the heat-sensitive recording layer may be, in particular, a roller blade coater, a knife coater, a curtain coater or an airbrush. The basis weight of the heat-sensitive recording layer is preferably between 2 and 6 g/m$^2$ and more preferably between 2.2 and 4.8 g/m$^2$.

In a very particularly preferred embodiment, the heat-sensitive recording material of the present invention includes a pigment-containing interlayer disposed between the substrate and the heat-sensitive recording layer.

Useful pigments for the interlayer include not only organic hollow pigments but also inorganic pigments, the latter selected with preference from the group comprising natural kaolin, calcined kaolin, silicon oxide and here particularly bentonite and also aluminium (hydr)oxide and here particularly boehmite. Such an interlayer can firstly make a positive contribution to levelling the surface to be coated, thereby reducing the amount of coating color which has to be applied for the heat-sensitive recording layer. This is why levelling coaters—roll coaters, knife coaters and (roller) blade coaters for example—command themselves for applying the pigment-containing interlayer. Secondly, the pigments in this interlayer are capable of imbibing the heat-liquefied wax constituents of the heat-sensitive recording layer at the script formation stage and thus promote fast and consistent functioning of the heat-induced recording technique. The basis weight of the pigment-containing interlayer is preferably between 5 and 20 g/m$^2$ and more preferably between 7 and 11 g/m$^2$.

Simply for just environmental reasons but also made technologically possible by the present invention, the heat-sensitive recording material proposed herein requires no protective layer covering the heat-sensitive recording layer. When applied to improve the recording material proposed herein with regard to environmental effects, such as humidity and UV irradiation, a protective layer is particularly suitable that in addition to a diacetone-modified polyvinyl alcohol includes in a first possible embodiment further binders, more particularly mixtures of various carboxyl- or silanol-modified polyvinyl alcohols. These then comprise not more than 40 wt %, preferably not more than 15 wt %, based on the total proportion of binder in the protective layer. In a second possible embodiment, the protective layer includes exclusively diacetone-modified polyvinyl alcohol as binder. Particularly when diacetone-modified polyvinyl alcohol is the sole binder in the protective layer covering the heat-sensitive recording layer, it is deemed particularly preferable for the binder content of the protective layer to be in a range extending from 35 to 65 wt %, based on the total weight of the protective layer.

Useful crosslinking assistants for inclusion in the protective layer include particularly those selected from the group comprising: boric acid, polyamine, epoxy resin, dialdehyde, formaldehyde oligomers, epichlorohydrin resin, adipic acid dihydrazide, dimethylurea, and melamine-formaldehyde. Mixtures of various crosslinking assistants are also possible.

It is then further preferable for the ratio of the wt % of binder, in particular of diacetone-modified polyvinyl alcohol, to the crosslinking assistant within the protective layer to be in a range extending from 20:1 to 5:1 and more preferably in a range extending from 12:1 to 7:1.

Particularly good results were obtained when the protective layer additionally contained an inorganic pigment. It is particularly advisable in this connection for the inorganic pigment to be selected from the group comprising silicon dioxide, aluminium hydroxide, bentonite, kaolin or a mixture thereof. More particularly, a ratio of pigment—very preferably with kaolin—to the diacetone-modified polyvinyl alcohol should be established in a range extending from 1:1.5 to 1:4.5, the ratio values being based on the respective wt % of pigment and polyvinyl alcohol in the protective layer.

The coating apparatus to apply the protective layer covering the heat-sensitive recording layer may be, in particular, a roller blade coater, a knife coater, a curtain coater or an airbrush. The basis weight of the protective layer is preferably between 1.0 and 3.0 g/m$^2$ and more preferably between 1.4 and 2.3 g/m$^2$.

Although the preferred view of the present invention is by no means limited to paper as the substrate, it is paper and most preferably here

- a coating basepaper that has not been surface treated in that it is a coating basepaper, which has not been treated in a sizepress or in a coating apparatus, and also
- a basepaper that has been surface finished using a size press, which is the substrate that has become established on the market not least because of its good environmental compatibility due to its good recycleability, and which is preferable for the purposes of the present invention. A basepaper having a low pH is advisable in this context. The use of calcium carbonate as a pigment within the basepaper is possible, but not preferable due to a potential influence being exerted on the heat-sensitive recording layer in the form of greying thereof. By contrast, kaolin, aluminium (hydr)oxide and here particularly boehmite and also bentonite are particularly good options for inclusion as pigments within the basepaper.

Possible substrates for the invention similarly include sheetings for example of polypropylene, polyolefin and polyolefin-coated papers, although there are not preferable having regard to the environmental consequences of such plastics and/or plastics-coated papers, without this enumeration being exclusive in character.

The particulars provided in the description and the claims in respect of the basis weight, the wt % (% by weight) and the parts by weight are each based on the "bonedry" weight, i.e., absolutely dry parts by weight. The numerical particulars in this regard in the observations concerning the organic pigments of the pigment-containing interlayer are computed from the "airdry" weight, i.e., air-dry parts by weight, minus the weight fraction of water in and around the pigments in their as-supplied form.

The invention is further clarified with reference to the following inventive examples and to the comparative example:

To form a paper web as web-shaped substrate both for inventive heat-sensitive recording materials and for the comparative heat-sensitive recording material, a paper furnish is mixed up in a mixing vat from eucalyptus pulp and other pulp fibres together with fillers and water. Further constituents included in the furnish are resin size for bulk sizing at 0.6 wt % (bonedry), based on the overall weight of the furnish, and also further customary additives, for example kaolin as pigment, and optical brighteners. After finalization, the furnish is subsequently sent to a Fourdrinier papermachine, where it is processed into a paper web having a basis weight of 35 g/m$^2$.

After gentle calendering, the paper web is sent into a roller blade coater integrated in the papermachine, where it is coated on the front with a pigmented interlayer having a basis weight of 9 g/m$^2$. The coating composition used for this purpose, i.e., to form the interlayer, includes

- calcined kaolin as pigment,
- styrene-butadiene latex as binder,
- starch as co-binder and further auxiliaries.

The paper web is dried while still within the papermachine, using radiant heaters and in contact with hot rolls, calendered here in a multi-roll calender and subsequently wound onto a tambour as semi-finished paper.

The semi-finished paper reel thus obtained is sent to a coating machine where the paper web is continuously unwound again into a roller blade coating means where prepared coating compositions each to form heat-sensitive recording layers are each applied at a basis weight of 4.2 g/m$^2$ to the previously applied and already dried pigmented interlayer. The components used for the coating composition used to form the heat-sensitive recording layer are:

| Function | Component | Comparative Example 1 | Example 1 | Example 2 |
|---|---|---|---|---|
| | | Wt % (bonedry) in the heat-sensitive recording layer | | |
| Dye precursor | 3-dibutylamino-6-methyl-7-anilinofluoran | 20.0 | 20.0 | 20.0 |
| (Color) developer | 3,5-di(α-methylbenzyl)salicylic acid | 35.0 | 31.0 | 18.0 |
| Auxiliary component | polyvinylpyrrolidone | — | 5.0 | 3.0 |
| Binder | polyvinyl alcohol | 15.0 | 15.0 | 14.0 |
| Dispersant | sulphonated polyvinyl alcohol | 6.0 | 5.0 | — |
| Pigment | kaolin | 14.0 | 14.0 | 27.0 |
| Auxiliary | slip agents: waxes; crosslinkers, defoamers | 10.0 | 10.0 | 18.0 |
| Whiteness % (with/without UV content) | — | 90/81 | 95/85 | 94/84 |
| Whiteness % (with/without UV content) after 7 days' storage at 40° C. and 95% relative humidity | — | 70/65 | 85/78 | 81/75 |

The heat-sensitive recording layer is subsequently dried using a hot air flotation dryer and in contact with hot rolls and calendered in a multi-roll calender. The final step is to roll up the then finalized inventive heat-sensitive recording materials and comparative heat-sensitive recording material.

To evaluate the inventive and comparative heat-sensitive recording materials thus obtained, samples are taken of each as comparatively small strips of paper and presented for further testing.

The whiteness of the heat-sensitive recording layer is determined on use of light once with and once without UV content, the measurements being carried out in accordance with the mandates of ISO 2469/ISO 2470 with the proviso that the measurements carried out herein use D65 light at an observer angle of 8°. The whiteness measurements are carried out using an Elrepho 3000 instrument (illuminant D 65/10). The values found are shown in the table above. An initial value of 90% (with UV content) is still just acceptable, which is achieved by the comparative example as well the inventive examples. However, values below 80% (with UV content) fall short of market acceptance, and therefore only the inventive examples are convincing here—a value of 70% (with UV content) after 7 days' storage at 40° C. and 95% relative humidity, see the corresponding value in the table for the comparative example, is simply no longer marketable.

It can be stated in summary that the examples confirm the expectations in full and corroborate the advantages of a heat-sensitive recording material as claimed herein.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A heat-sensitive recording material comprising:

a web-shaped substrate having a front side and an opposite reverse side; and at least one heat-sensitive recording layer on at least one of the sides of the web-shaped substrate, wherein the at least one heat-sensitive recording layer contains at least one dye precursor;

at least one salicylic acid derivative as a color developer reactive with this at least one dye precursor;

polyvinylpyrrolidone as an auxiliary component augmenting the color developer; and a binder comprising at least one of polyvinyl alcohol, sulphonated polyvinyl alcohol, and a combination of polyvinyl alcohol and sulphonated polyvinyl alcohol, wherein the at least one salicylic acid derivative is 3,5-di(α-methylbenzyl)salicylic acid.

2. The heat-sensitive recording material according to claim 1, wherein the 3,5-di(α-methylbenzyl)salicylic acid is a sole color developer in the at least one heat-sensitive recording layer.

3. The heat-sensitive recording material according to either of claim 2, wherein the at least one heat-sensitive recording layer includes as a dye precursor at least one substance selected from a group consisting of:

3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran.

4. The heat-sensitive recording material according to either of claim 1, wherein the at least one heat-sensitive recording layer includes as a fluoran-based dye precursor at least one substance selected from a group consisting of:

3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran.

5. The heat-sensitive recording material according to claim 4, wherein a wt % (bonedry) ratio of the fluoran-based dye precursor to said 3,5-di(α-methylbenzyl)salicylic acid is in a range extending from 1.0:0.6 to 1.0:1.9.

6. The heat-sensitive recording material according to claim 1, wherein a wt % (bonedry) ratio of 3,5-di(α-methylbenzyl)salicylic acid to polyvinylpyrrolidone is in a range extending from 1.0:0.1 to 1.0:0.25.

7. The heat-sensitive recording material according to claim 1, wherein the at least one heat-sensitive recording layer further comprises:

a pigment.

8. The heat-sensitive recording material according to claim 7, wherein the pigment in the at least one heat-sensitive recording layer is at least one of kaolin and aluminium (hydr)oxide.

9. The heat-sensitive recording material according to claim 8, wherein an amount of pigment in the at least one heat-sensitive recording layer is in a range extending from 12 to 30 wt % (bonedry), based on an overall weight of the at least one heat-sensitive recording layer.

10. The heat-sensitive recording material according to claim 7, wherein an amount of pigment in the at least one heat-sensitive recording layer is in a range extending from 12 to 30 wt % (bonedry), based on an overall weight of the at least one heat-sensitive recording layer.

11. The heat-sensitive recording material according to claim 1, wherein the at least one heat-sensitive recording material further includes a pigment-containing interlayer disposed between the web-shaped substrate and the at least one heat-sensitive recording layer.

* * * * *